US005232037A

United States Patent [19]

Fraser

[11] Patent Number: 5,232,037

[45] Date of Patent: Aug. 3, 1993

[54] VENETIAN BLINDS

[75] Inventor: Donald E. Fraser, Owensboro, Ky.

[73] Assignee: Hunter Douglas Inc., Upper Saddle River, N.J.

[21] Appl. No.: 823,699

[22] Filed: Jan. 21, 1992

[51] Int. Cl.[5] ..... E06B 3/48

[52] U.S. Cl. ..... 160/115; 160/176.1

[58] Field of Search ..... 160/168.1, 115, 176, 160/174, 175, 166, 173, 116, 114

[56] References Cited

U.S. PATENT DOCUMENTS

| | | | |
|---|---|---|---|
| 2,673,607 | 3/1954 | Rulfs | 160/115 |
| 4,628,979 | 12/1986 | Hsu | 160/115 |
| 4,651,794 | 3/1987 | Bytheway, Jr. | 160/168 |
| 4,708,188 | 10/1987 | Bytheway, Jr. | 160/174 |

FOREIGN PATENT DOCUMENTS 3022314 6/1980 Fed. Rep. of Germany .

*Primary Examiner*—Blair M. Johnson

[57] ABSTRACT

A venetian blind in which there are at least two sets of slat supports each in the form of ladders, each set of ladder support comprising two or more ladders these ladders each having longitudinally spaced cross-rungs at the same location with one group of venetian blind slats being mounted on the cross-rungs of one of the ladders of each set and other slats being mounted on the other cross-rungs. In use, in an open position of the blind, the two or more slats at the safe location are superimposed on one another. The two or more ladders of each set are independently controllable to provide different visual effects in the closed position of the blind.

In another construction used for a skylight, individual slats are mounted between depending double cross-rungs of the slat support ladders.

8 Claims, 9 Drawing Sheets

VENETIAN BLINDS

BACKGROUND OF THE INVENTION

This invention relates generally to venetian blinds.

Venetian blinds traditionally consist of two or more sets of slat supports each in the form of ladders, usually ladder cords or ladder tapes, these each having a first and second longitudinally extending elongate flexible element and a plurality of longitudinally spaced rungs. Slats are mounted to the rungs of the ladder means to be supported thereby. Ladder means are controllable by so called tilt rolls upon which the elongate flexible elements are engaged, so that rotation of the generally horizontal axis tilt rolls causes one longitudinal element to go up and the other to go down, thereby tilting the slats. A lift cord usually extends down through the slats and has attached to its lower end a bottom rail so that when operation of the lift cords takes place, the bottom rail is raised, raising with it the slats.

Such venetian blinds are fully satisfactory in that they enable one to adjust the amount of light entering a room and can readily be fully opened by pulling on the lift cords. However, from an aesthetic point of view there is little facility for variation of the general appearance.

SUMMARY OF THE INVENTION

The present invention aims to provide a greater variability in the aesthetic appearance of a venetian blind while not adversely effecting the operation thereof.

It is now proposed, therefore, according to the present invention to provide a venetian blind comprising, in combination:

a) a plurality of sets of slat supports, each set of slat supports comprising a plurality of ladder means, each ladder means comprising first and second longitudinally extending elongate flexible elements and a plurality of longitudinally spaced rungs, the rungs of all of the ladder means being located at substantially the same longitudinally spaced locations;

b) a plurality of groups of elongate slats extending transversely to the longitudinally extending flexible elements and supported by the rungs of said ladder means, each slat of a group being supported by a separate one of the rungs of each set at that location, said slats having a width perpendicular to the length of the slats, the sum of the widths of all of the slats of each group exceeding the distance between said longitudinally spaced locations; and c) tilt means connected to the elongate flexible elements of said ladder means, said tilt means being effective to ensure that, during each operation thereof, for all of the sets of slat supports, the first flexible element of each ladder means is moved a different distance than its associated second flexible element and the flexible elements of each ladder means are moved differently from the flexible elements of the other ladder means, whereby, when the tilt means is operated fully in one sense the slats of each group are tilted to an open position in which the slats of a group are in superimposed relation and when the tilt means is operated fully in the opposite sense, the slats of a group are tilted to a closed position, in which the slats of a group overlap at their adjacent edges and overlap the slats of the next group.

With such a structure one may have two or more sets of ladder means each with its own set of slats of each set being, in one position, that is to say the open position, at the same location, one on top of the other. This will give the effect of a far more open appearance to the venetian blind than is normal because there will be larger gaps between the slats than conventionally. However, operation of the blinds towards and finally to the other position can give a different effect. When operated to the other extreme position, that is to say the closed position, the blind will look just like a conventional blind in its closed position. Particularly attractive effects can be achieved by providing the slats of one set of a one colour or pattern and the slats of the other set or sets of different colours or patterns. Raising and lowering of the blind will be just the same as in the conventional blind, however.

The tilt means may comprise a housing and a tilt roll associated with each set of slat support means and rotatably mounted relative to the housing. One of the flexible elements of the ladder means can be connected to the housing and the other to the tilt roll. This can be done in a variety of ways. For example one can connect the first flexible element of one ladder means and the second flexible element of the other ladder means to the housing and the second flexible element of the one ladder means and the first flexible element of said another ladder means of each set to the tilt roll. The first element of the one ladder means and the second element of the another means can be connected to opposite sides of the tilt roll or to the same side. In an alternative arrangement the first flexible element of both the one ladder means and the another ladder means can be connected to the housing and the second flexible element of both the one ladder means and of the another means can be connected to the tilt roll on opposite sides thereof, thereby to effect opposite tilting of the slats associated with the two ladder means.

An alternative arrangement is for the tilt means to comprise a housing and tilt roll associated with each of the plurality of sets of slat supports the tilt roll being rotatably mounted relative to the housing and having, for each set, a smaller diameter portion and a larger diameter portion. As before, the first and second flexible elements of the ladder means can be connected either to the larger diameter portion or to the smaller diameter portion and if three or more ladder means are provided for each set, and therefore three or more groups of slats, then the variation can be increased by connecting one of the flexible elements of some of the ladder means to the housing and the other to either the larger or smaller portion of the relevant tilt roll to give several different visual effects.

In some instances it is useful to have a venetian blind arrangement to cover a sky light in a horizontal inclined roof.

The invention also, therefore, contemplates a venetian blind comprising a plurality of sets of slat supports, each slat support comprising a ladder comprising first and second longitudinally extending elongate flexible elements, a plurality of longitudinally spaced double rungs, first and second tilt means one at each of two opposite ends of said first and second flexible elements, means mounting said first and second tilt means whereby said flexible elements extend horizontally, or inclined to the vertical, means guiding said first and second elements whereby said first element forms an upper element and a second element forms a closely adjacent lower element and said double rungs depend downwardly therebelow and a plurality of slats each engaged in a separate one of said double rungs and supported thereby to hang below said first and second flexible elements.

Preferably each slat further comprises notches adjacent one edge thereof, alternate ones of slats having the notches extending upwardly and downwardly and engaged with an associated double rung. A support cable may be associated with the first flexible element to support said first flexible element and may pass through the double rungs adjacent the first flexible element.

The advantage of this structure is that it is very simple to manufacture and whatever the inclination of the ceiling in which the skylight is affixed the slats will always hang vertically in the open position of the blind.

These and other objects of the present invention will become more apparent from the following description which is given merely by way of example, and with reference to the accompanying drawings.

DETAILED DESCRIPTION OF PREFERRED EMBODIMENTS

Figure 1:
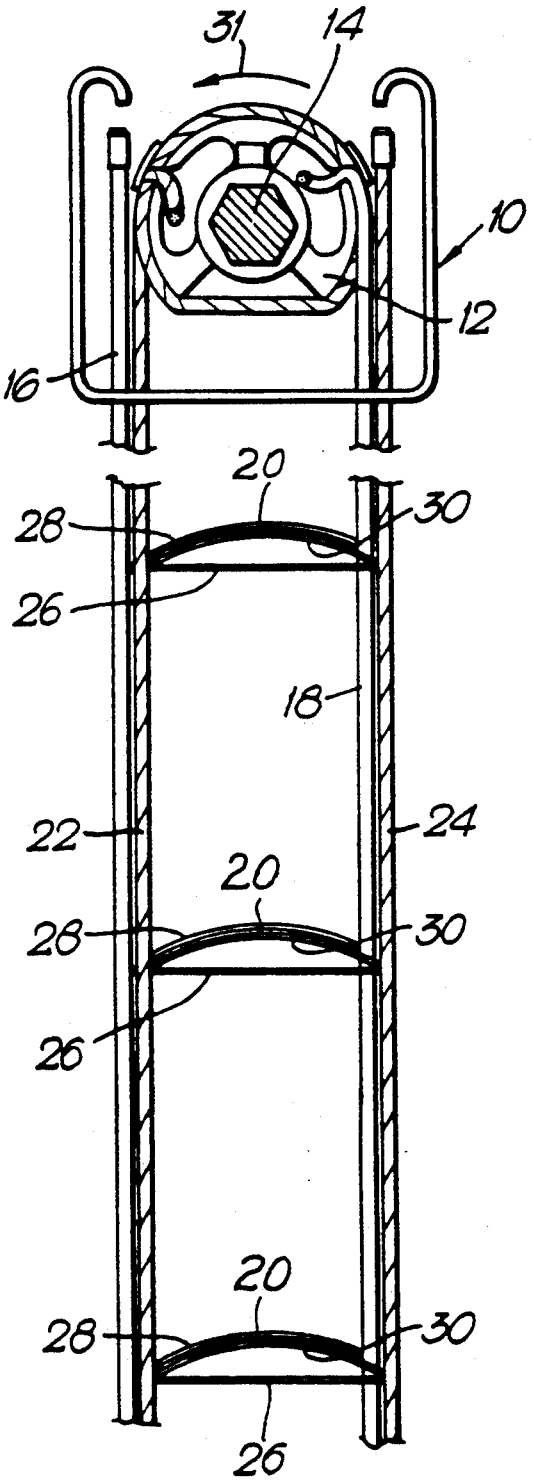
FIG. 1 is a side elevation of one embodiment of a venetian blind according to the invention shown in an open position.

If reference is first made to FIG. 1, it will be seen that there is a conventionally generally channel shaped cross section housing or head rail 10 in which is rotatably mounted a tilt roll 12 rotatable by a conventional hexagon cross section tilt rod 14.

At each of a plurality of locations along the length of the blind are provided a set of ladder means. Each set of ladder means associated with the head rail 10 and the tilt roll 12 is provided with two ladder means. The first of these ladder means includes a first elongate flexible element 16 and second elongate flexible element 18 joined by cross rungs 20 which are longitudinally spaced approximately twice the normal distance, as will be explained more below. A second ladder means includes a first elongate flexible element 22 and a second elongate flexible element 24. For ease of understanding the first and second elongate elements 22,24 of the second ladder means have been shown cross-hatched, whereas those 16,18 of the first ladder means have been shown plain. It will be observed that the element 16 is secured to the housing or head rail 10 as is the second element 24 of the second ladder means. The first element 22 of the second ladder means is connected to the left side of the tilt roll 12 having been wrapped a full turn there around and the second elongate element of the first ladder means 18 is connected to the other side of the tilt roll 12.

Mounted on the cross rungs 20,26 are slats 28,30 respectively. Each slat may be notched at the location of its cross rung 20,26 so that the elongate member of the other ladder means not associated therewith can pass freely through the notches.

As will be seen from FIG. 1, in the open position of the blind in which the spacing between the rungs 20,26 can be seen to be approximately twice the width of the slat, the slats 28 sit directly in overlying relation to the slats 30 and are engaged thereon.

Figure 1A:
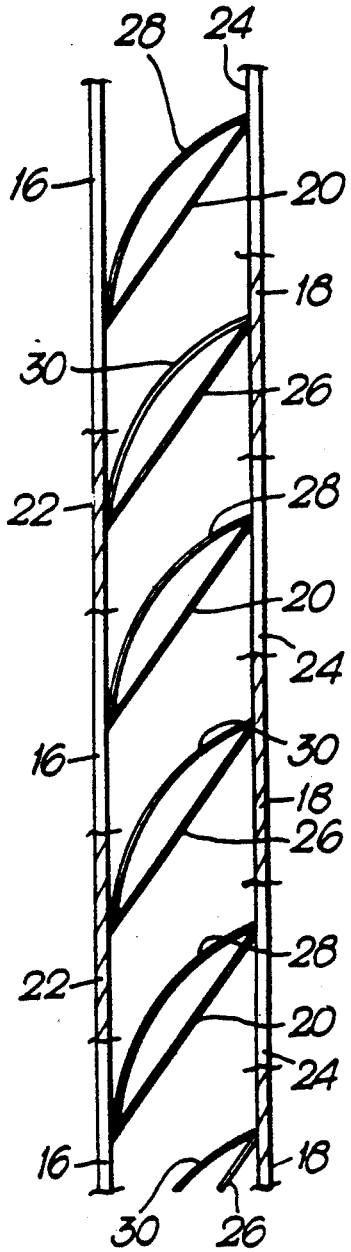
FIG. 1A is a similar view showing the slats tilted to a closed position.

Now if the tilt roll 12 is tilted in a counterclockwise direction as indicated by the arrow 31, that is to the location shown in FIG. 1A, elongate elements 16 and 24 will remain unmoved and elongate element 22 will drop downwardly while elongate element 18 will rise upwardly. In FIG. 1A apparent breaks in the elongate flexible element have been shown to illustrate elongate elements 16,18,20 and 22 and their new positions. It will be observed that in FIG. 1A the slats 28,30 now take up a position in which they block off a view through the blind. In fact the slats can be tilted still further so that they more closely overlie one another.

Figure 2:
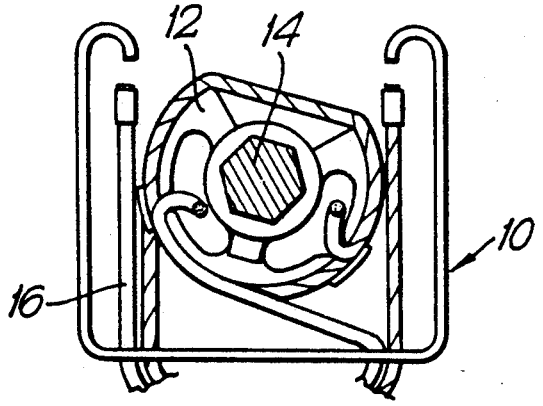
FIG. 2 is a further similar view showing the slats tilted in the opposite position to a "staggered" position.
Figure 2:
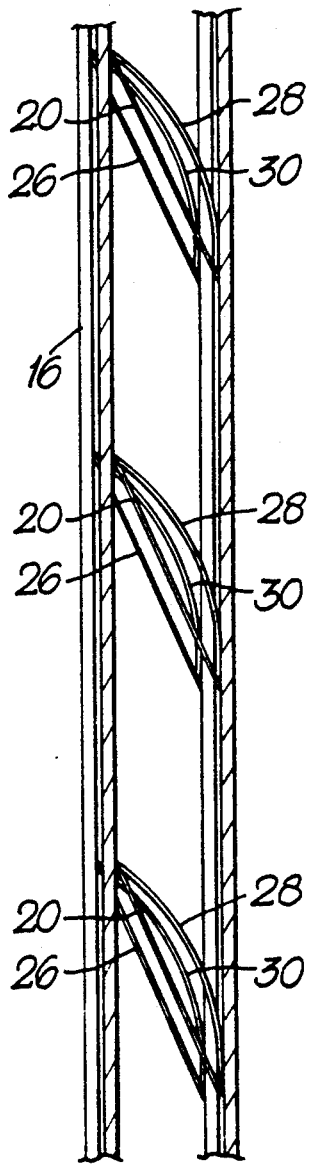

If on the other hand the tilt roll 12 is rotated in the opposite direction to that indicated by the arrow 31, that is in a clockwise direction, then the arrangement shown in FIG. 2 will result because slats 28 will remain lying on top of the slats 30 and will be tilted and moved to the staggered position shown therein which will give a very different visual effect from that of FIG. 1A leaving smaller gaps therebetween than the gaps provided by the "horizontal" position of FIG. 1.

Figure 3:
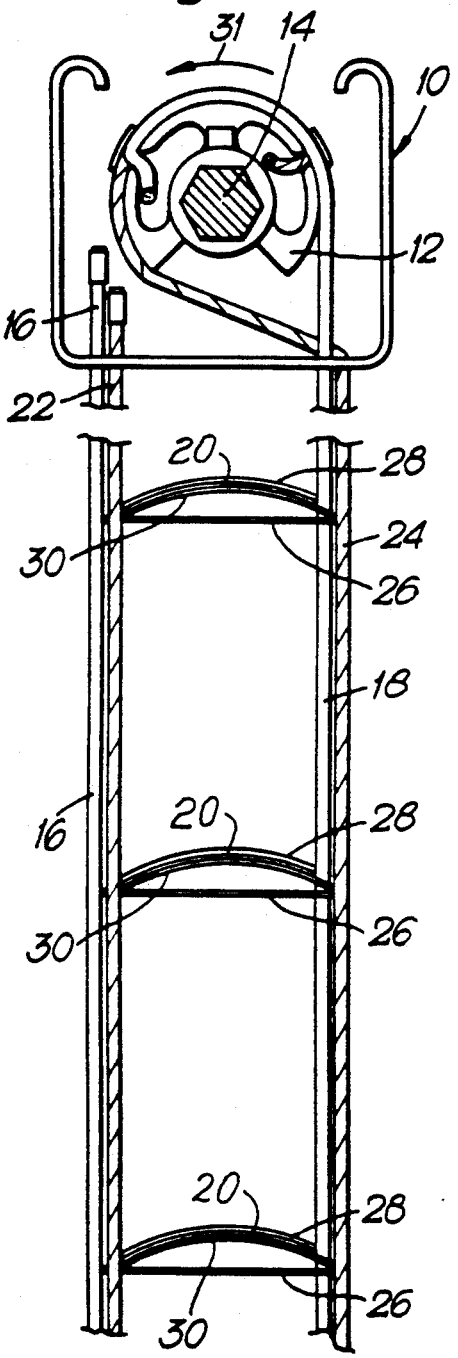
FIG. 3 is a similar view of a second embodiment of a venetian blind according to the invention shown in the open position.
Figure 3A:
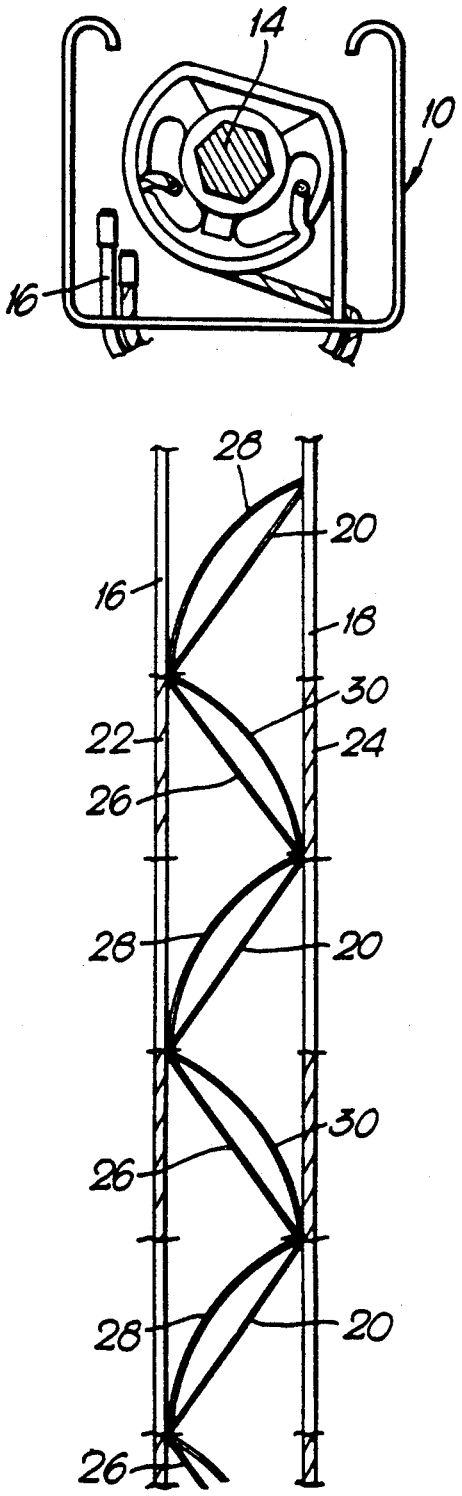
FIG. 3A is a similar view showing the slats tilted to a "pleated look" position.

FIG. 3 and FIG. 3A illustrate a second embodiment in which like parts have been indicated by like reference numerals. The only difference here, however, is that both of the first elements 16,22 are connected, as seen on the left hand side, to the housing or head rail 10. The second elements 18,20 are connected to opposite sides of the tilt roll 12.

The effect of this is that when the tilt roll is tilted from the position illustrated in FIG. 3 in the direction of the arrow 31 so that it arrives at the position shown in FIG. 3A, element 24 will move up and element 18 will move down, while elements 16 and 22 remain fixed. This will give the effect shown in FIG. 3A providing what might be described as a "pleated" look in which the view through the window associated with the blind is completely obscured. To ensure overlap, the bottom edges of each of the slats 28,30 may be notched.

A further embodiment of the blind is illustrated in FIGS. 4, 4A–4C and FIG. 5 and again like parts have been indicated by like reference numerals. In this construction, however, there is a further ladder tape provided at each location and a further slat is mounted on the rungs of that third ladder tape making, at each location, a group of three slats, a top slat, a middle slat and a bottom slat. In this instance the bottom slat tapes have the plain elongate members 16,18 the middle slat tapes have the cross-hatched elongate members 22,24 and top slat tapes have elongate members 23,25 indicated by chain-dotted lines. The rungs associated with these tapes are indicated by the reference numerals 20,26 and 27 respectively and the longitudinal spacing between the groups of rungs is approximately three times the normal spacing. These rungs support slats 28,30 and 31.

Figure 4:
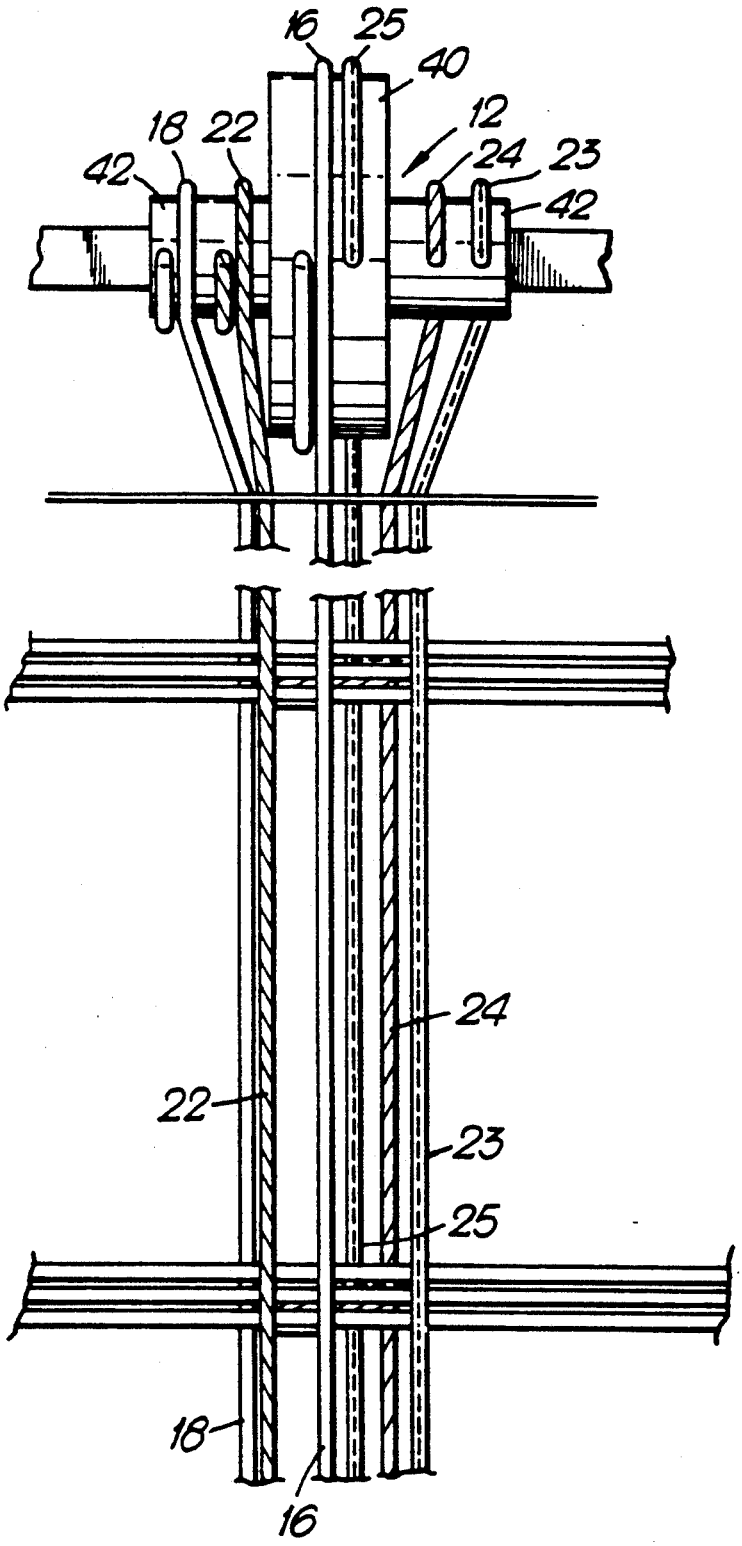
FIG. 4 is a fragmentary front elevation of a further embodiment of a venetian blind according to the invention shown in the open position.

It will be seen there that there is a major difference in the tilt mechanism. The tilt roll assembly 12 consists of a central larger diameter portion 40 and a smaller diameter portion 42 extending on either side thereof, the larger diameter portion 40 being approximately three times the diameter of the smaller diameter portion 42. If reference is made to FIGS. 4 and 4A it will be seen that the elongate members 23,25 of the top slat tape are wound on the same side of the smaller and larger diameters 42 and 40 respectively. FIGS. 4 and 4B show that the middle slat tape elongate members 22,24 are connected on opposite sides of the smaller diameter portion 42 and the bottom slat elongate members 16,18 are connected on the other side of the smaller diameter portion 42.

Figure 4A:
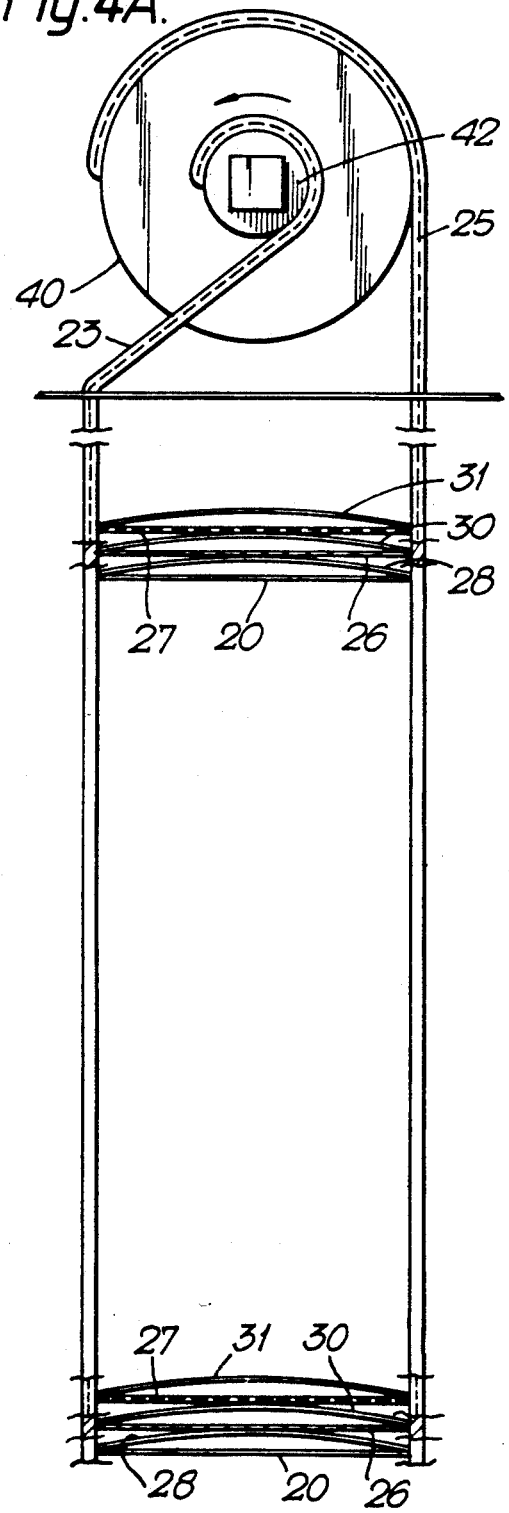
FIG. 4A is a schematic side elevation of the blind of FIG. 4 in the open position showing details of the top slat tape.
Figure 4B:
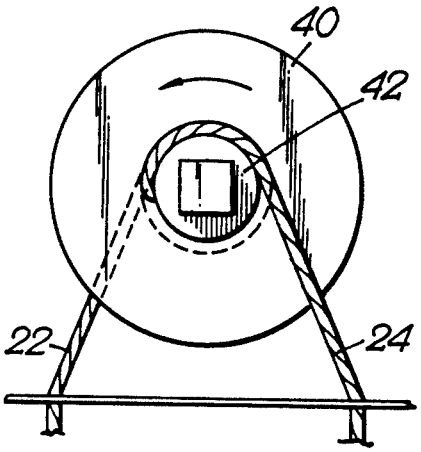
FIGS. 4B and 4C are schematic views of the top portion of the blind showing details of the middle slat tape and the bottom slat tape respectively.
Figure 4C:
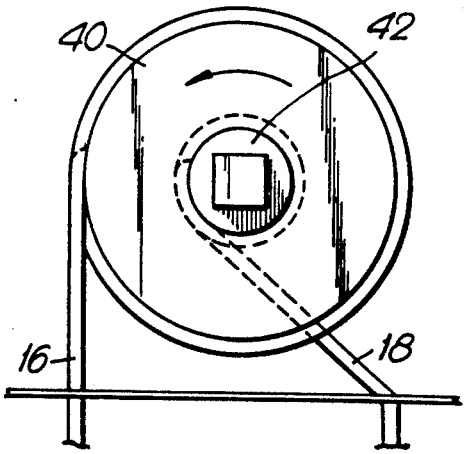
Figure 5:
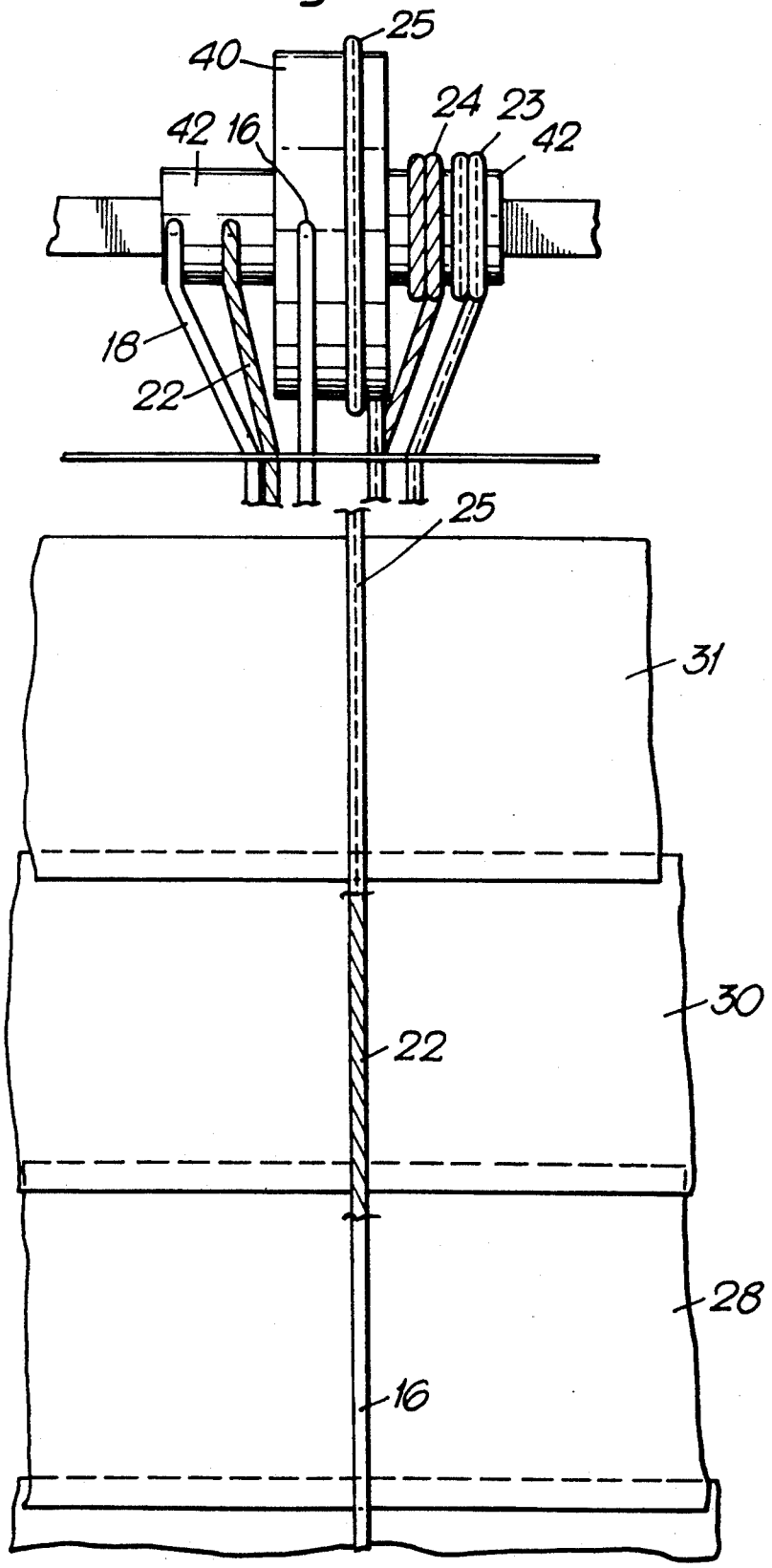
FIG. 5 is a view similar to FIG. 4 but showing the slats in the closed position.

As can be seen in FIG. 5, if the tilt roll 40,42 is rotated in an anti-clockwise from that illustrated in FIG. 4A, the slats will take up the closed overlapping position indicated if FIG. 5. The overlap of the slats is achieved by setting the tape locators or rungs higher on the middle and bottom slats. Because of the different diameters of the tilt roll portions 40 and 42, the elongate members 16 and 25 will move three times faster than the remaining tapes.

FIG. 6 and FIGS. 6A–6D illustrate a still further embodiment in which, at each location, there are provided four sets of ladders each with four times the normal pitch and four groups of slats. These are referred to as a top slat, a top middle slat, a bottom middle slat and a bottom slat. In this construction there is a similar tilt roll 40,42 but here the diameter of the larger diameter portion is twice that of the smaller diameter portion and certain of the elongate members of the lower tapes are secured to the housing or head rail. In the particular configuration illustrated, the top slat is supported by the ladder of the elongate members 16,18 indicated plain, the top middle slats 31 are supported by the ladder tape having the elongate members 23,25 indicated by the chain-dotted lines, the bottom middle slats 30 are supported by the ladder tape having the elongate members 22,24 indicated cross-hatched and the bottom slats 33 are supported by the ladder tapes having the elongate members 19,21 indicated by the dot-dash lines.

Figure 6:
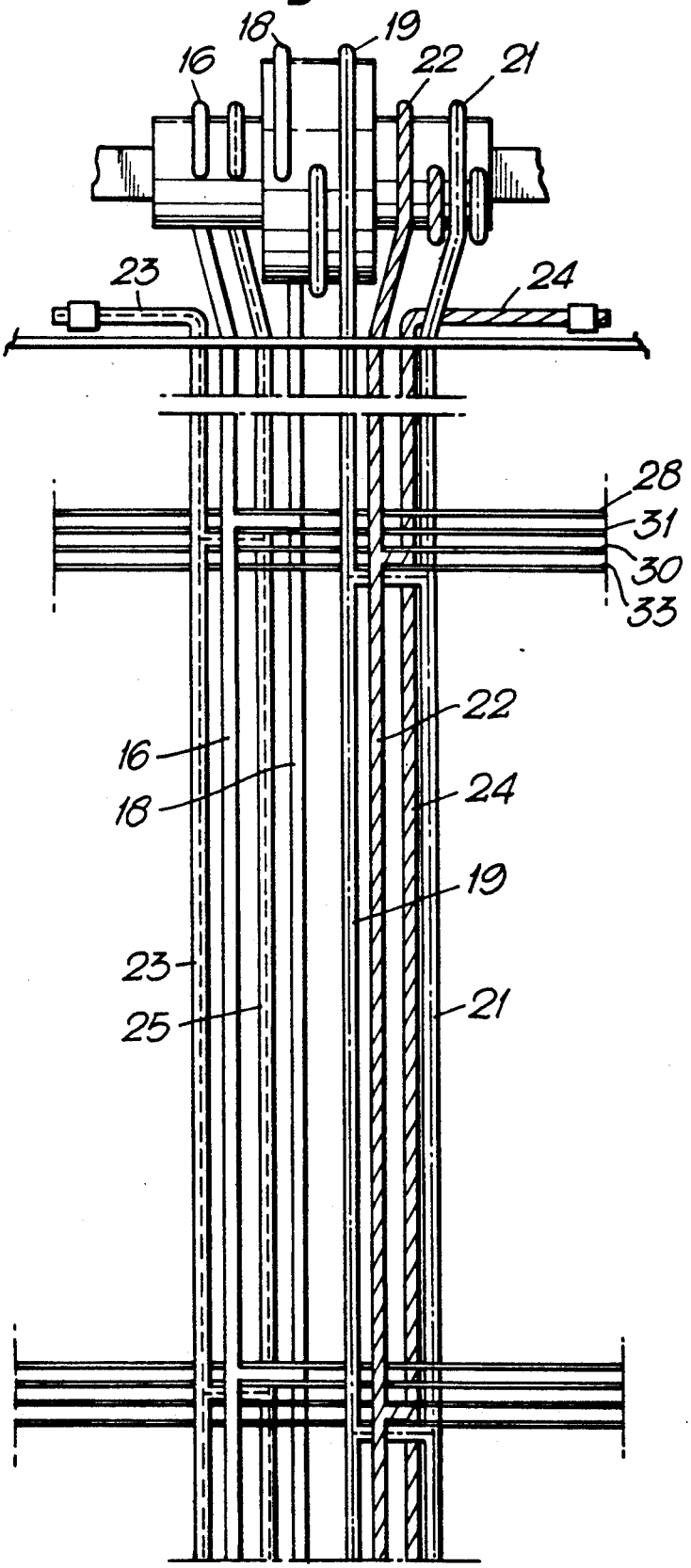
FIG. 6 is a view similar to FIG. 5 of a still further embodiment.
Figure 6A:
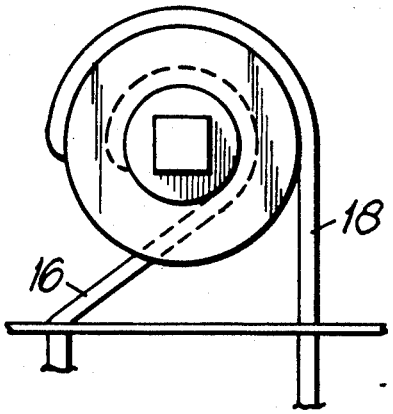
FIGS. 6A, 6B, 6C, 6D are views of the top, the top middle, the bottom middle and the bottom slat tapes as they are connected to the tilt mechanism.
Figure 6B:
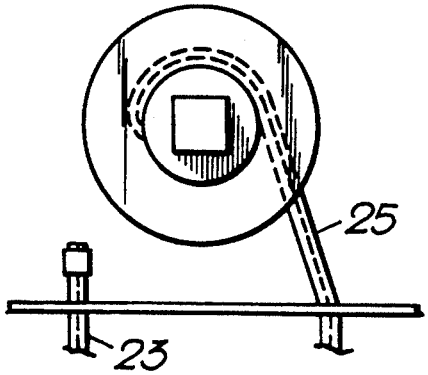
Figure 6C:
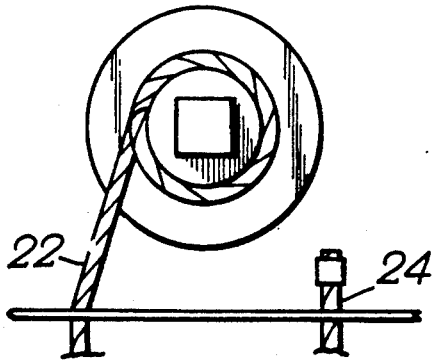
Figure 6D:
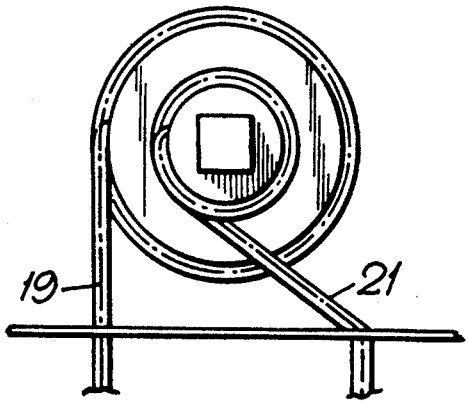

It can be seen in FIG. 6A that the elongate members 16 and 18 are respectively wrapped around the same of the smaller and larger diameter portions 42,40 respectively, that the top middle slat tape elongate members 23 and 25 are connected to the housing or head rail and to the same side of the smaller roll portion 42 whereas the bottom middle slat tape is mounted the other way round, that is to say with the first elongate portion 22 wrapped around the other side of the smaller roll portion 42 and the housing respectively. Finally, the bottom slat tape elongate members 19 and 21 are mounted in effect in mirror image to those of the top slat tapes, that is around the larger and smaller roll portion 40,42 respectively but on the other side thereof from those of the top slat tape.

Figure 7:
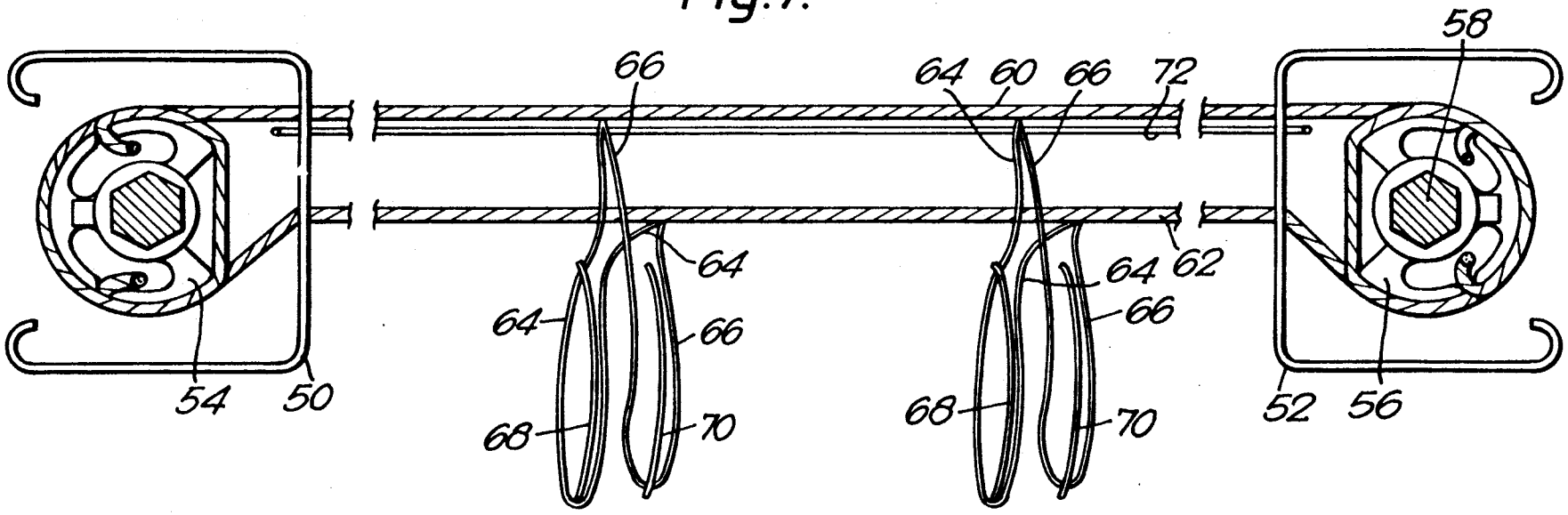
FIGS. 7 and 7A are views of a further embodiment of a venetian blind according to the invention for use with a skylight.
Figure 7A:
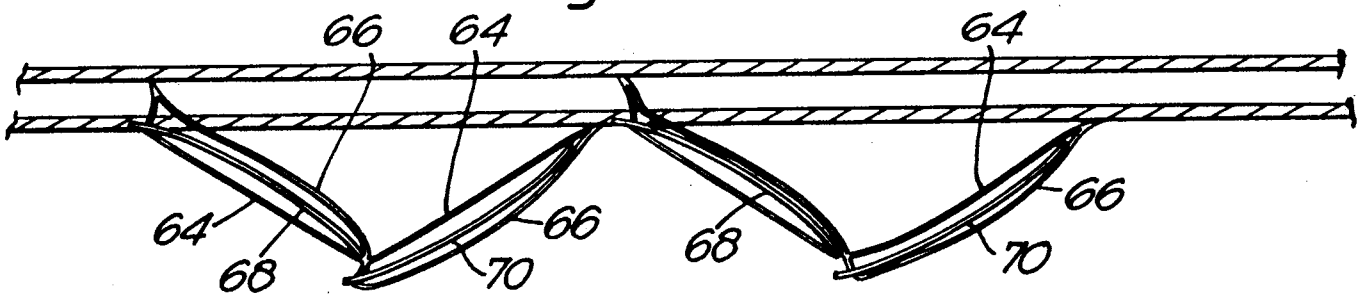

Turning now to the structure of the venetian blind shown in FIGS. 7 and 7A, this is intended to be mounted below a skylight which may be horizontal, in the orientation as shown or may be inclined to an angle of up to 40° to the horizontal.

The illustrated construction comprises two housings or head rails 50,52 in which are mounted an idler tilt roll 54 and a driver tilt roll 56, driven in rotation about its axis by a tilt rod 58 and a mechanism (not shown). Extending around the tilt roll 54,56 is a ladder tape having and upper and lower elongate members 60,62. These being of the conventional type which has double cross rungs, each rung having a first portion 64 and a second portion 66 each connected to the elongate members 60 and 62. As illustrated, these double rungs hang downwardly below the lower elongate member 62 to form a generally loose loop. Had the elongate member 60,62 been mounted in a normal vertical orientation rather than horizontal orientation as shown, they would be spaced apart by the normal width of a slat and in fact the pitch between the rungs 64,66 would be approximately equal that width of the slat. Thus if it were a normal 50 mm (2") tape, then the rungs would be approximately 50 mm apart.

Mounted in the loose loops are narrower slats e.g. 25 mm (1") slats 68,70. The slats 68 are provided with notches at their upper edge and the slats 70 with notches at their lower edge, these being engaged by the rungs 64,66 respectively. As can be seen in FIG. 7 a support wire 72 extends under tension between the headrails 50,52 and passes through the space between the double rungs 64,66 just below the upper elongate member 70. This serves to maintain that member and to a certain extent also the lower element 62 substantially straight. In the position illustrated in FIG. 7 the slats will hang by gravity in substantially vertical planes. If one then operates the driver tilt roll 56 so that it rotates in a counter-clockwise direction then the upper elongate flexible element 60 will move to the left and the lower element 62 to the right to take up eventually the position illustrated in FIG. 7A, in which the slats 68,70 collectively extend substantially fully to obscure light passing downwards through the skylight above the assembly of the invention. Operation of the tilt roll in the reverse direction will restore the slats to the vertical position as shown in FIG. 7. Regardless of the orientation of the assembly, that is to say, whether or not the flexible elements 60,62 are horizontal or are inclined to the horizontal, the slats will always hang vertically downwardly in the "neutral" position and can be caused to take up the position as indicated in FIG. 7A by operation of the tilt rolls.

It is contemplated that a further tension wire similar to wire 72 could be associated with the flexible element 62 and that one could use modified ladder tapes in which loops extend on the far side of the elongate member 60,62 in a further small loop through which the tension member could pass.

I claim:

1. A venetian blind comprising, in combination:

a) a plurality of sets of slat supports, each set of slat supports comprising a plurality of ladder means, each ladder means comprising first and second longitudinally extending elongate flexible elements and a plurality of longitudinally spaced rungs, the rungs of all of the ladder means being located at substantially the same longitudinally spaced locations in an open position of the blind;

b) a plurality of groups of elongate slats extending transversely to the longitudinally extending flexible elements and supported by the rungs of said ladder means, each slat of a group being supported by a separate one of the rungs of each set at that location, said slats having a width perpendicular to the length of the slats, the sum of the widths of all of the slats of a group exceeding the distance between said longitudinally spaced locations; and c) tilt means connected to the elongate flexible elements of said ladder means, said tilt means being effective to ensure that, during each operation thereof, for all of the sets of slat supports, the first flexible element of each ladder means is moved a different distance than its associated second flexible element and the flexible elements of each ladder means are moved differently from the flexible elements of the other ladder means, whereby, when the tilt means is operated fully in one sense the slats of each group are tilted to an open position in which the slats of a group are in superimposed relation and when the tilt means is operated fully in the opposite sense, the slats of a group are tilted to a closed position, in which the slats of a group overlap at their adjacent edges and overlap the adjacent slats of the next group such that the blind is closed.

2. A venetian blind as claimed in claim 1, wherein said tilt means comprises a housing and a tilt roll associated with each set of slat support means and rotatably mounted relative to said housing, the first flexible element of one ladder means and the second flexible element of another ladder means of each slat support being connected to said housing and the second flexible element of said one ladder means and the first flexible element of said another ladder means of each set being connected to said tilt roll.

3. A venetian blind as claimed in claim 2, wherein said first flexible element of said one ladder means and said second flexible element of said another ladder means are connected to opposite sides of said tilt roll.

4. A venetian blind as claimed in claim 1, wherein said tilt means comprises a housing and a tilt roll associated with each set of slat support means and rotatably mounted relative with said housing, the first flexible element of one ladder means and the first flexible element of another ladder means of each slat support being connected to the housing and the second flexible element of said one ladder means and the second flexible element of said another ladder means being connected to opposite sides of said tilt roll thereby to effect opposite tilting of the slats associated with two ladder means.

5. A venetian blind as claimed in claim 1, wherein said tilt means comprises a housing and a tilt roll associated with each of said plurality of sets of slat supports, said tilt roll being rotatably mounted relative to said housing, the tilt roll for each set having a smaller diameter tilt roll portion and a larger diameter tilt roll portion, the first flexible element of one ladder means and the second flexible element of another ladder means being connected to said smaller diameter portion and the second flexible element of said one ladder means and a second flexible element of another ladder means being connected to the larger diameter portion.

6. A venetian blind as claimed in claim 1, wherein said tilt means comprises a housing and a tilt roll for each set having a smaller diameter tilt roll portion and a larger diameter tilt roll portion, wherein the first flexible element of a first ladder means is connected to one side of the larger diameter portion, wherein the first flexible element of a second ladder means and the second flexible element of said first ladder means are connected to the same side of said smaller diameter portion, wherein the first flexible element of a third ladder means and a second flexible element of a second ladder means are connected to the other side of said smaller diameter portion and wherein said second flexible element of said third ladder means are connected to the other side of the larger diameter portion.

7. A venetian blind as claimed in claim 1, wherein said tilt means comprises a housing and a tilt roll for each set having a smaller diameter tilt roll portion and a larger diameter tilt roll portion, wherein the second flexible element of said first ladder means is connected to one side of the larger diameter portion, wherein the first flexible element of a first ladder means and the second flexible element of a second ladder means are connected to one side of said smaller diameter portion, wherein the first flexible element of a second ladder means and the second flexible element of a third ladder means are connected to said housing, wherein the first flexible element of said third ladder means and the second flexible element of a fourth ladder means are connected to the other side of said small diameter portion and wherein the first flexible element of said fourth ladder means are connected to said other side of said larger diameter portion.

8. A venetian blind as claimed in claim 1, wherein said slats extend substantially in a horizontal plane when the tilt means is operated fully in said one sense.

* * * * *